United States Patent [19]

Alberghini

[11] 4,247,012

[45] Jan. 27, 1981

[54] BOTTOM STRUCTURE FOR PLASTIC CONTAINER FOR PRESSURIZED FLUIDS

[75] Inventor: Alfred C. Alberghini, Dunwoody, Ga.

[73] Assignee: Sewell Plastics, Inc., Atlanta, Ga.

[21] Appl. No.: 66,295

[22] Filed: Aug. 13, 1979

[51] Int. Cl.[3] ..... B65D 1/02

[52] U.S. Cl. ..... 215/1 C; 220/70

[58] Field of Search ..... 215/1 C; 220/70

[56] References Cited

U.S. PATENT DOCUMENTS

| | | | |
|---|---|---|---|
| 3,870,181 | 3/1975 | Sincock | 215/1 C |
| 4,108,324 | 8/1978 | Krishnakumar | 215/1 C |

*Primary Examiner*—Donald F. Norton

*Attorney, Agent, or Firm*—Quaintance, Murphy & Richardson

[57] ABSTRACT

A plastic container, especially well suited for carbonated beverage bottles, with a specially designed bottom to minimize stress and improve parison blowing is disclosed. The bottom end has a modified hemispherical shape contiguous with the sidewalls and a continuous seating ring, for stably supporting the bottle on a flat surface which is of convex annular shape and positioned between the seating ring and a center portion is an intermediate portion. The intermediate portion consists of two truncated cones defining an excluded volume. The first truncated cone has a generatrix of about 18° and the second truncated cone has a generatrix of about 55°. The excluded volume defined by the first and second truncated cones is increased by an odd number of equally sized and equally spaced semi-ellipsoid shaped portions. The center portion is convex and particularly designed for positioning the parison in the mold for blow molding.

9 Claims, 6 Drawing Figures

BOTTOM STRUCTURE FOR PLASTIC CONTAINER FOR PRESSURIZED FLUIDS

BACKGROUND OF THE INVENTION

1. Field of the Invention

The present invention relates to disposable blow-molded pressure-resistant plastic bottles having particular utility as containers for carbonated beverages. The present invention relates particularly to such a plastic bottle having a bottom design employing a continuous seating ring upon which the bottle rests when placed on a smooth horizontal surface in a normal upright position. The present invention further relates to a novel bottom design within the seating ring which will not evert when the bottle is sealed and the inside of the bottle subject to substantial pressure due to containment of a carbonated beverage or the like.

2. Summary of the Prior Art

Blow-molded plastic bottles for containing liquids at elevated pressures are known and have found increasing acceptance particularly in the beverage industry for use as one-way disposable containers. Plastic bottles of this type are subject to a number of structural and functional criteria which have presented many problems not previously considered. Solutions to the problems offered by the prior art have yielded interesting results but have not been entirely satisfactory.

Some of the criteria which must be considered are the flexible properties of the plastic making up the bottle particularly where the contained liquid will be carbonated and thus present an elevated pressure within the bottle when sealed which will be absent both prior to sealing and subsequent to opening the bottle. Moreover, the bottle must conform to the size and shape of prior art glass bottles employed for the same purpose so as to conform to the handling requirements of the existing equipment used in filling the bottles. Further, the plastic bottle, blown from a parison, is limited to certain modification by the very nature of the blowing process and the available materials for use in forming such a bottle.

When used with carbonated beverages, the bottle may be subjected to internal pressures normally between 40 and 100 psi and occasionally as high as 200 psi under severe conditions. The load experienced by the plastic bottle is greatest at the bottom of the container. Various designs have been employed to effectively deal with this load condition, the designs falling into three general subclasses.

The first sub-class of bottom design is typified by U.S. Pat. No. 3,722,725 and consists generally of a hemispherical bottom to which is added, as a separate member, a base cup which supports the bottle in an upright position. While this basic design has been widely adopted, the required assembly of the two pieces to form the self-supporting bottle is an undesirable feature requiring assembly time, manpower and machinery which might be eliminated if a satisfactory one-piece bottle could be designed.

The second sub-class of bottom designs is typified by U.S. Pat. No. 3,759,410 wherein a plurality of feet are integrally formed in the base of the bottle upon which the bottle rests. While this design has the advantage of the single element construction, the nature of the blowing process and the resins employed make reliable formation of the feet difficult often resulting in uneven stresses which may cause a "rocker effect" of the bottle when sealed. There has also been some resistance to the acceptance of this type of bottle design due in part to its "different" look.

The third sub-class of bottom designs, and the subclasses in which the present invention resides, is represented by U.S. Pat. Nos. 3,468,443; 3,511,401; 3,643,829; 3,722,726; and 3,870,181. The bottom of each of these designs includes a continuous peripheral seating ring upon which the bottle rests surrounding a concave central portion. This concave central portion forms a space which is not included within the bottle itself, but rather is between the bottle bottom and any planar surface upon which the bottle is placed. The term "excluded volume" is adopted to conveniently refer to this space. Various designs have been adopted for that portion of the bottle bottom within this seating ring which are intended to strengthen the bottle bottom and prevent the bottom from everting when subjected to internal pressure. Particular constraints are presented when the resins employed achieve maximum strength upon bi-axially stretching. Further none of the prior art designs of this sub-class have provided for "parison tip capture" relative to blowing mold prior to the blowing process.

It is therefore an aim of the present invention to provide a design for a blow-molded one piece plastic beverage container having a continuous seating ring with bottom design which will not evert under pressure yet will provide for centering of the parison within the blowing mold thereby assuring axial uniformity in the structure of a bottle employable on presently existing conventional bottling equipment.

SUMMARY OF THE INVENTION

The present invention provides for the manufacture of a plastic bottle of sufficient strength and able to withstand stress and axial load which is a suitable container for a pressurized fluid, particularly the carbonated beverages. The bottle has a generally cylindrical sidewall portion with a conventional opening at its upper end and a bottom portion which is unique. The portion adjacent to the sidewall portion has a modified hemispherical shape which is contiguous with the sidewall. A continuous seating ring stably supports the bottle when placed on a flat surface in an upright position. The seating ring is of a convex annular shape when viewed from below and the outer wall is contiguous with the modified hemispherical shape and the inner wall is contiguous with an intermediate portion. The seating ring has a diameter of 0.50 to 0.95 of the diameter of the cylindrical bottle. The intermediate portion is positioned between the seating ring and the center portion.

The intermediate portion can be visualized as consisting of two truncated cones a concave surface bounding an excluded volume. The first truncated cone has a generatrix of about 18° and the base of the first cone is contiguous with the seating ring. The second truncated cone has a generatrix of about 55° and the base of the second cone is contiguous with the inner terminus of the first truncated cone. The term generatrix as employed here means a line which, when revolved about an axis of revolution coincident with the axis of the bottle, generates the surface of a cone. The excluded volume defined by the first and second truncated cones is increased by an odd number of equally sized and equally spaced semi-ellipsoid shaped portions. Each semi-ellipsoid shaped portion can be viewed as a segment of the surface of an ellipsoid which extends from the base of the first truncated cone to the inner terminus of the second truncated cone.

The center portion is contiguous with the inner terminus of the second truncated cone and is convex as viewed from below. The bottle may be blow molded from a variety of plastics, polyethylene terephthalate and acrylonitrile being preferred.

DESCRIPTION OF PREFERRED EMBODIMENTS

Figure 1:
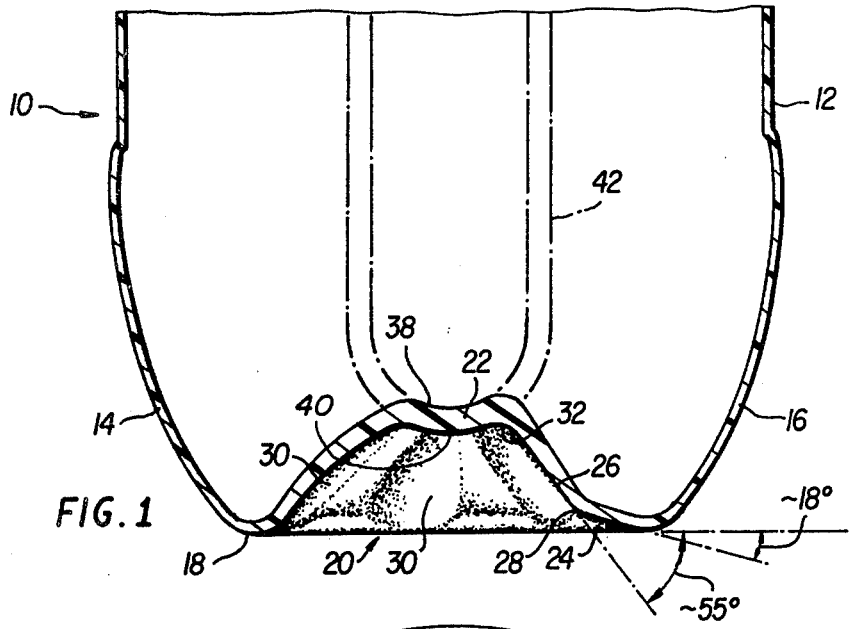
FIG. 1 is a sectional view of a preferred embodiment of a bottle of the present invention, the section taken along line 1—1 in FIG. 2.
Figure 4:
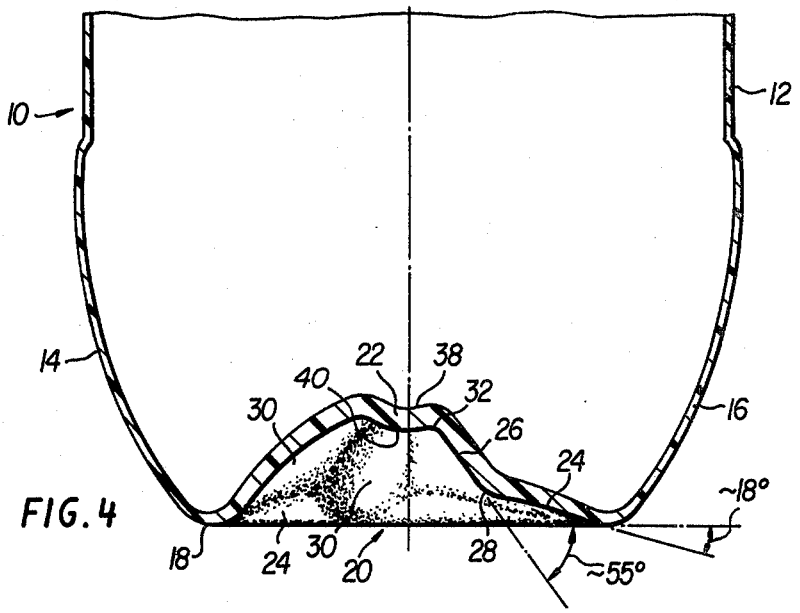
FIG. 4 is a sectional view of a second preferred embodiment of a bottle of the present invention, the section taken along line 4—4 in FIG. 5.

There are illustrated in FIGS. 1 and 4 sectional views of two preferred embodiments of the present invention consisting of a bottle 10 having a generally cylindrical sidewall portion 12 with an opening at its upper end (not shown). A bottom portion 14 is provided at the lower end of the sidewall portion 12. The bottom portion 14 may be viewed as consisting of a modified hemispherical shape 16 contiguous to the sidewall 12 terminating in a continuous seating ring 18 which stably supports the bottle 10 when placed on a flat surface in an upright position.

Figure 2:
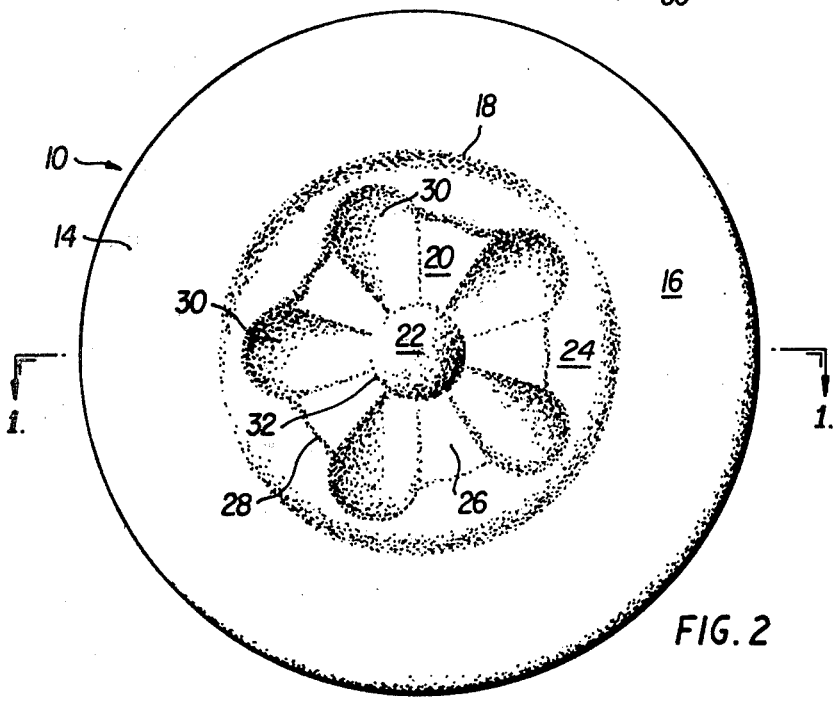
FIG. 2 is a plan view from the bottom of the bottle illustrated in FIG. 1.
Figure 5:
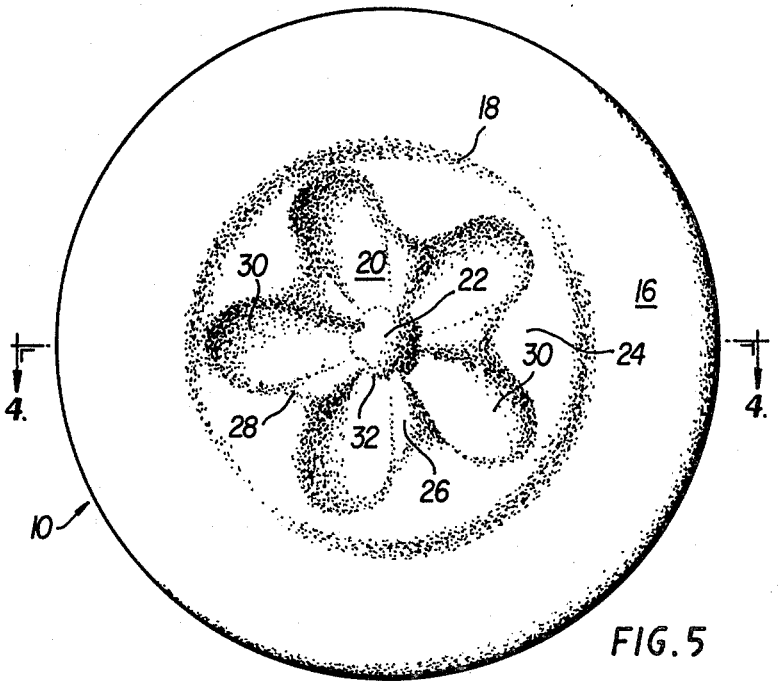
FIG. 5 is a plan view from the bottom of the bottle illustrated in FIG. 4.

The continuous seating ring 18 is shown in FIGS. 2 and 5 to be a convex annular shape when viewed from below. The outer wall of the seating ring 18 is contiguous with the modified hemispherical shape 16 while the inner wall of the seating ring is contiguous with an intermediate portion 20. The seating ring can advantageously have any diameter from about 0.5 to 0.95 the diameter of the cylindrical sidewall portion 12 of bottle 10.

The intermediate portion 20 is positioned between the seating ring 18 and a center portion 22. The intermediate portion 20 consists of a surface shaped by two truncated cones which define a concave surface bounding an excluded volume. The walls of the first truncated cone 24 have a generatrix of about 18° with respect to a horizontal line H-H defining the base of the cone. The base of the first cone is contiguous with the seating ring 18. The walls of the second truncated cone have a generatrix of about 55° with respect to the base of the cone. The base of the second cone is contiguous with the inner terminus 28 of the first truncated cone.

The excluded volume defined by the first and second truncated cone is increased by an odd number of equally sized and equally spaced semi-ellipsoid shaped portions 30. Each semi-ellipsoid shaped portion can be viewed as a segment of the surface of an ellipsoid which extends from the base of the first truncated cone at or near the seating ring 18 to the inner terminus of the second truncated cone 32 adjacent the center portion 22.

The center portion 22 is contiguous with the inner terminus of the second truncated cone and is convex as viewed from below. This convex nature of the center portion is best viewed in the cross-sectional view of FIGS. 1 and 4.

The diameter of the center portion 22 is only about 20% of the diameter of the seating ring 18. The inner concave surface 38 and the outer convex surface 40 of the center portion 22 maintains the location of the preform 42 (shown in phantom in FIG. 1) forming the bottle 10 during the blowing process such that no axial mis-alignment can occur thus preventing unwanted variations in the thickness of the bottle wall or bottom.

Figure 3:
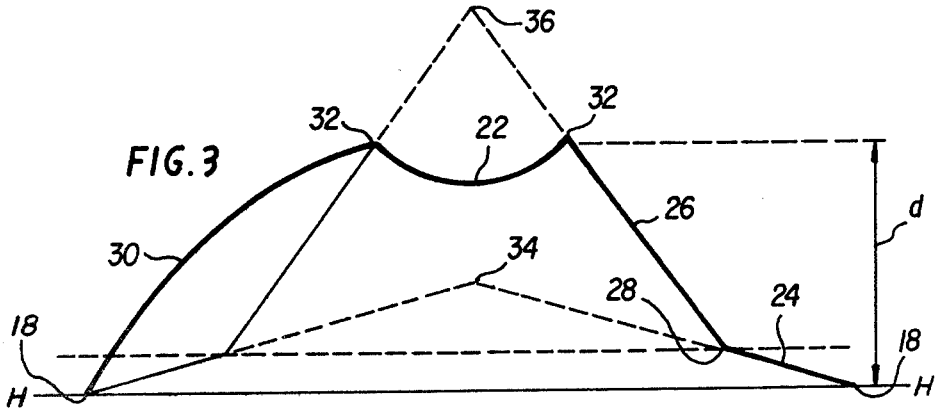
FIG. 3 is a diagram illustrating, in sections, two truncated cones forming the embodiment of FIGS. 1 and 2.
Figure 6:
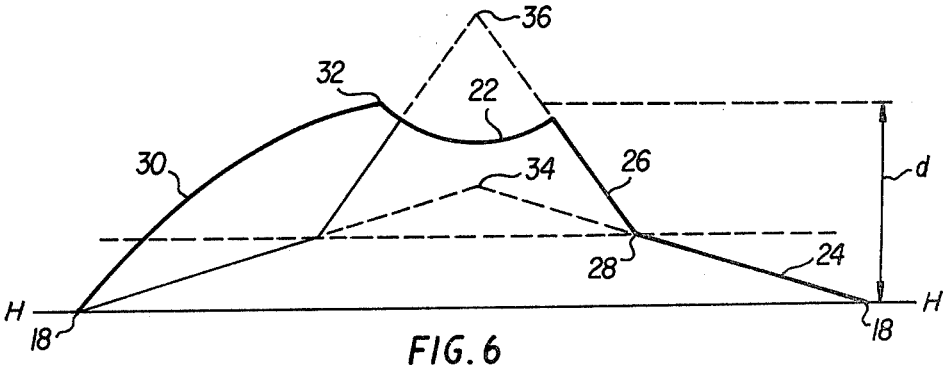
FIG. 6 is a diagram illustrating, in section, the two truncated cones forming the embodiment of FIGS. 4 and 5.

A diagramatic view of the various elements is presented in FIGS. 3 and 6. It will be appreciated that some smoothing of curves occurs particularly at the two terminus points 28 and 32 and at the seating ring point 18 when the design is actually carried into practice as illustrated in FIGS. 1 and 2. The first of the two truncated cones can be seen as that cone having apex 34 but which extends from seating ring 18 to the first inner terminus 28. The second of the two truncated cones can be seen to be that cone having apex 36 but truncated so as to be employed between the first inner terminus 28 and the second inner terminus 32.

The depth d of the space defined by the two truncated cones is preferably at least 20% of the diameter of the seating ring 18 and is more typically 30% of the diameter of the seating ring. It is believed that an inadequate depth d would not grant the structure the strength sufficient to resist everting when the bottle is placed under pressure.

The radius of curvature of the larger of the two radii of the semi-ellipsoid shaped portions 30 of both embodiments is about two-thirds the diameter of the seating ring 18. The generatrix of either of the cones need not be linear but may also be curved slightly as illustrated most clearly in FIG. 4, the radius of curvature of the generatrix being at least one and one-quarter times the seating ring diameter so as to be essentially planar.

The radial extent of the walls 24 of the first truncated cone are shown to be less than the radial extent of the walls 26 of the second truncated cone in FIG. 3. This situation is reversed in FIG. 6 where the radial extent of the walls 24 of the first truncated cone is slightly greater than the radial extent of the walls 26 of the second truncated cone. In general, the radial extent of the first truncated cone is between 50% and 90% of the radial extent of the entire intermediate portion 20.

While the exact nature of the configuration which aids in resisting the tendency of the bottom to evert under pressure is not known, it is believed that it is linked to the axial asymetry presented by the odd number of semi-ellipsoid intrusions into the double truncated conical structure, five such intrusions being preferred. This asymetric presentation of structure is believed to create an asymetric pattern of force which stabilizes the intermediate portion of the bottle when subjected to elevated internal pressures.

While two specific examples have been herein illustrated of preferred embodiments of the invention, it will be understood that they are merely representative and not exhaustive of bottle designs incorporating the invention which is hereafter defined by the appended claims.

What is claimed is:

1. A bottle formed of a polymer for containing a pressurized fluid, said bottle comprising:

a. a generally cylindrical sidewall portion having an opening at its upper end, and b. a bottom portion at the lower end of said sidewall portion having (1) a modified hemispherical shape, contiguous with the sidewall (2) a continuous seating ring, for stably supporting said bottle when placed on a flat surface in an upright position, which is of convex annular shape when viewed from below, the outer wall of the seating ring being contiguous with the modified hemispherical shape and the inner wall of the seating ring being contiguous with an intermediate portion, said seating ring having a diameter of 0.5 to 0.95 of the diameter of the cylindrical bottle, (3) an intermediate portion positioned between the seating ring and a center portion and contiguous therewith, said intermediate portion consisting of two truncated cones defining a concave surface bounding an excluded volume, the first truncated cone having a generatrix of about 18°, the base of the first cone being contiguous with the seating ring; the second truncated cone having a generatrix of about 55°, the base of the second cone being contiguous with the inner terminus of the first truncated cone, and the excluded volume defined by the first and second truncated cones being increased by an odd number of equally sized and equally spaced semi-ellipsoid shaped portions, each semi-ellipsoid shaped portion extending from the base of the first truncated cone to the inner terminus of the second truncated cone, and (4) a center portion contiguous with the inner terminus of the second truncated cone, the inner portion being convex as viewed from below.

2. A bottle of claim 1 wherein the polymer is polyethylene terephthalate.

3. A bottle of claim 1 wherein the polymer is acrylonitrile.

4. A bottle of claim 1 wherein the depth of the space defined by the two truncated cones is at least 20% of the seating ring diameter.

5. A bottle of claim 1 wherein there are five semi-ellipsoid shaped portions.

6. A bottle of claim 1 wherein the radius of curvature of the semi-ellipsoid shaped portions is about $\frac{2}{3}$ the seating ring diameter.

7. A bottle of claim 1 wherein the first truncated cone occupies between 50% and 90% of the radial extent of the intermediate portion.

8. A bottle of claim 1 wherein the diameter of the center portion is at least 20% of the seating ring diameter.

9. A bottle formed of a polymer for containing a pressurized fluid, said bottle comprising:

a. a generally cylindrical sidewall portion having an opening at its upper end, and b. a bottom portion at the lower end of said sidewall portion having (1) a modified hemispherical shape, contiguous with the sidewall, (2) a continuous seating ring, for stably supporting said bottle when placed on a flat surface in an upright position, which is of convex annular shape when viewed from below, the outer wall of the seating ring being contiguous with the modified hemispherical shape and the inner wall of the seating ring being contiguous with an intermediate portion, said seating ring having a diameter of 0.5 to 0.95 of the diameter of the cylindrical bottle, (3) an intermediate portion positioned between the seating ring and a center portion and contiguous therewith, said intermediate portion consisting of two truncated cones defining a concave surface bounding an excluded volume, the depth of the space defined by the two truncated cones being at least 20% of the seating ring diameter, the first truncated cone having a generatrix of about 18°, the base of the first cone being contiguous with the seating ring, the second truncated cone having a generatrix of about 55°, the base of the second cone being contiguous with the inner terminus of the first truncated cone, and the excluded volume defined by the first and second truncated cones being increased by five equally sized and equally spaced semi-ellipsoid shaped portions, each semi-elipsoid shaped portion extending from the base of the first truncated cone to the inner terminus of the second truncated cone and having a radius of curvature of the larger of the two radii of the semi-ellipsoid portion of about $\frac{2}{3}$ the seating ring diameter, the first truncated cone occupying between 50 and 90% of the radial extent of the intermediate portion, and (4) a center portion contiguous with the inner terminus of the second truncated cone, the inner portion being convex as viewed from below, the diameter of the center portion being at least 20% of the seating ring diameter.

* * * * *